US010337152B2

(12) United States Patent
Dignard et al.

(10) Patent No.: US 10,337,152 B2
(45) **Date of Patent: *Jul. 2, 2019**

(54) DUAL-UNIT PAVING SYSTEM

(71) Applicant: Oldcastle Building Products Canada Inc., Saint John (CA)

(72) Inventors: Stephane Dignard, Montreal (CA); John Penterman, Montreal (CA)

(73) Assignee: Oldcastle Building Products Canada Inc., Saint-John (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/116,164

(22) Filed: Aug. 29, 2018

(65) Prior Publication Data

US 2018/0371702 A1 Dec. 27, 2018

Related U.S. Application Data

(63) Continuation of application No. 15/688,023, filed on Aug. 28, 2017, now Pat. No. 10,087,585, which is a (Continued)

(51) Int. Cl.
*E01C 11/02* (2006.01)
*E01C 5/00* (2006.01)
(Continued)

(52) U.S. Cl.
CPC ..... *E01C 11/02* (2013.01); *B44F 9/04* (2013.01); *E01C 5/00* (2013.01); *E01C 5/005* (2013.01);
(Continued)

(58) Field of Classification Search
CPC ... E01C 5/005; E01C 5/00; E01C 5/06; E01C 15/00; E01C 2201/14; E01C 3/006; E01C 13/04; E01C 2201/06; E04F 13/147
See application file for complete search history.

(56) References Cited

U.S. PATENT DOCUMENTS 653,515 A 7/1900 Kennedy
815,547 A * 3/1906 Messmore ..... E04F 13/0864 52/316
(Continued)

FOREIGN PATENT DOCUMENTS

BE 570711 11/1961
CA 1150553 7/1983
(Continued)

OTHER PUBLICATIONS

U.S. Appl. No. 14/577,856, Dec. 2014, Castonguay et al.
(Continued)

*Primary Examiner* — Abigail A Risic
(74) *Attorney, Agent, or Firm* — Merchant & Gould P.C.

(57) ABSTRACT

A dual-unit paving system for covering a surface has pairs of first and second units. For each pair, the first and second unit have different respective shapes and sizes, and are configured to be matingly engageable for forming a hexagonal assembly having six, non-linear sides. The hexagonal assembly allows forming rotational tessellations. The first and second units are also shaped and configured to be matingly engageable so as to form horizontally aligned tessellations, and also vertically aligned tessellations.

10 Claims, 15 Drawing Sheets

Related U.S. Application Data continuation of application No. 15/195,877, filed on Jun. 28, 2016, now Pat. No. 9,752,288, which is a continuation of application No. 14/409,169, filed as application No. PCT/CA2013/050463 on Jun. 7, 2013, now Pat. No. 9,404,226.

(60) Provisional application No. 61/661,008, filed on Jun. 18, 2012.

(51) Int. Cl.

| | |
|---|---|
| ***E01C 5/06*** | (2006.01) |
| ***E01C 15/00*** | (2006.01) |
| ***B44F 9/04*** | (2006.01) |
| ***E04F 13/14*** | (2006.01) |

(52) U.S. Cl.

CPC ..... *E01C 5/06* (2013.01); *E01C 15/00* (2013.01); *E04F 13/147* (2013.01); *E01C 2201/14* (2013.01); *E04F 2201/09* (2013.01)

(56) References Cited

U.S. PATENT DOCUMENTS 1,474,779 A 11/1923 Zur Kammer August
1,479,647 A 1/1924 Carroll
1,600,787 A 9/1926 Ardit
1,953,657 A 4/1934 Pierce
2,050,299 A 8/1936 Evers
D102,144 S 12/1936 Parker
2,605,681 A 8/1952 Thrief
2,606,428 A 8/1952 Oldfather
2,662,343 A 12/1953 Rice
2,893,098 A 7/1959 Tilley
2,991,213 A 7/1961 Williams
3,171,335 A 3/1965 Pincon et al.
D204,803 S 5/1966 Leeth
3,267,823 A 8/1966 MacRae
3,386,001 A 5/1968 Slosberg et al.
3,600,773 A 8/1971 Davis
D230,478 S 2/1974 Littman et al.
D231,926 S 6/1974 Appleton
3,870,423 A 3/1975 Pietz, Jr.
3,903,702 A 9/1975 Appleton
3,947,192 A 3/1976 Rosenberger
4,026,083 A 5/1977 Hoyt et al.
4,078,760 A 3/1978 Mullins
4,105,354 A 8/1978 Bowman
4,125,341 A 11/1978 Reinschutz
4,131,406 A 12/1978 Fresquez
4,135,840 A 1/1979 Puccini et al.
4,217,740 A 8/1980 Assanti
4,231,677 A 11/1980 Roming
D257,824 S 1/1981 Puccini et al.
D257,825 S 1/1981 Puccini et al.
4,287,141 A 9/1981 Russell
4,313,689 A 2/1982 Reinschutz
4,349,293 A 9/1982 Rosenberger
4,354,773 A 10/1982 Noack
4,407,480 A 10/1983 Trimmer et al.
D272,037 S 1/1984 Puccini
4,452,419 A 6/1984 Saleeba
4,510,725 A 4/1985 Wilson
4,544,305 A 10/1985 Hair
D281,505 S 11/1985 Larsesn et al.
4,572,699 A 2/1986 Rinninger
4,609,303 A 9/1986 Shumaker
4,627,764 A 12/1986 Scheiwiller
D287,884 S 1/1987 Scheiwiller
4,761,095 A 8/1988 Bartlechner
4,773,790 A 9/1988 Hagenah
4,776,723 A 10/1988 Brimo
4,792,257 A 12/1988 Rinninger
4,828,426 A 5/1989 Hendricks et al.
4,834,575 A 5/1989 Barth
4,838,728 A 6/1989 McKeever
4,919,565 A 4/1990 Göpfert
4,921,372 A 5/1990 Hybertson
D314,240 S 1/1991 Scheiwiller
4,997,308 A 3/1991 Welling, Jr.
5,051,023 A 9/1991 Yoshida et al.
5,108,219 A * 4/1992 Hair ..... E01C 5/00 404/41
5,133,620 A 7/1992 Scheiwiller
5,201,843 A 4/1993 Hair
5,211,895 A 5/1993 Jacklich, Sr.
5,230,584 A 7/1993 Grossman
5,244,303 A 9/1993 Hair
D342,528 S 12/1993 Hupp
5,267,810 A * 12/1993 Johnson ..... E01C 5/06 404/41
D343,237 S 1/1994 Johnson, II
D343,238 S 1/1994 Hair
5,277,514 A * 1/1994 Glickman ..... E01C 5/06 404/41
5,281,047 A 1/1994 Skaug
5,286,139 A 2/1994 Hair
D349,967 S 8/1994 Krueger et al.
5,342,142 A 8/1994 Barth et al.
5,348,417 A 9/1994 Scheiwiller
5,449,245 A 9/1995 Glickman
5,486,066 A 1/1996 Hagenah
5,487,526 A 1/1996 Hupp
5,496,129 A 3/1996 Dube
5,520,388 A 5/1996 Osborn
5,524,396 A 6/1996 Lalvani
5,560,173 A 10/1996 Scheiwiller
5,568,391 A 10/1996 Mckee
5,588,775 A 12/1996 Hagenah
5,597,591 A 1/1997 Hagenah
5,619,830 A 4/1997 Osborn
5,625,990 A 5/1997 Hazlett
5,645,369 A 7/1997 Geiger
5,678,370 A 10/1997 Douglas
5,713,155 A 2/1998 Prestele
5,797,698 A 8/1998 Barth et al.
D397,802 S 9/1998 Terry
D399,978 S 10/1998 Barth et al.
D404,147 S 1/1999 Woolford
5,884,445 A 3/1999 Woolford
5,887,846 A 3/1999 Hupp
5,902,069 A 5/1999 Barth et al.
5,921,705 A 7/1999 Hodson et al.
5,941,657 A * 8/1999 Banze ..... E01C 5/06 404/39
5,945,181 A * 8/1999 Fisher ..... B44C 3/123 428/33
D424,212 S 5/2000 Abbrancati
D426,897 S 6/2000 Abbracati
6,073,411 A 6/2000 Ciccarello
D429,343 S 8/2000 Milot
D429,530 S 8/2000 Fleishman
D431,870 S 10/2000 Ziegler, Jr.
D431,871 S 10/2000 Abbrancati
6,168,347 B1 1/2001 Milot et al.
D439,677 S 3/2001 Mattox
6,263,633 B1 7/2001 Hagenah
D452,015 S 12/2001 Aurelius
RE37,694 E 5/2002 Riccobene
D463,866 S 10/2002 Jang
6,471,440 B1 10/2002 Scheiwiller
D471,990 S 3/2003 Riccobene
6,536,988 B2 3/2003 Geiger
D480,819 S 10/2003 Barbier
6,668,484 B2 12/2003 Riccobene
D486,246 S 2/2004 Manthei
D488,566 S 4/2004 Fleishman
6,715,956 B1 4/2004 Weber et al.
D492,796 S 7/2004 Price
6,881,463 B2 4/2005 Riccobene
D505,733 S 5/2005 Castonguay et al.
D506,013 S 6/2005 Anderson et al.
D522,667 S 6/2006 Castonguay et al.
D536,058 S 1/2007 Riccobene

(56) References Cited

U.S. PATENT DOCUMENTS

| | | | | |
|---|---|---|---|---|
| D537,501 | S | 2/2007 | Riccobene | |
| D537,959 | S | 3/2007 | Castonguay et al. | |
| D540,954 | S | 4/2007 | Bouchard | |
| D541,436 | S | 4/2007 | Wissman | |
| D543,642 | S | 5/2007 | Castonguay et al. | |
| D550,375 | S | 9/2007 | Thomassen et al. | |
| D553,260 | S | 10/2007 | Castonguay et al. | |
| D553,759 | S | 10/2007 | Hamel | |
| 7,393,155 | B2 * | 7/2008 | Riccobene | B44C 3/123 404/38 |
| 7,425,106 | B2 | 9/2008 | Altmann et al. | |
| D578,658 | S | 10/2008 | Keys | |
| D586,925 | S | 2/2009 | Riccobene | |
| D590,070 | S | 4/2009 | Castonguay et al. | |
| D590,071 | S | 4/2009 | Castonguay et al. | |
| D590,072 | S | 4/2009 | Castonguay et al. | |
| D602,173 | S | 10/2009 | Thomassen | |
| D602,604 | S | 10/2009 | Harris | |
| D606,210 | S | 12/2009 | Thomassen | |
| 7,637,688 | B2 | 12/2009 | Riccobene | |
| 7,674,067 | B2 | 3/2010 | Riccobene | |
| D618,364 | S | 6/2010 | Schrom et al. | |
| D620,616 | S | 7/2010 | Ciccarello | |
| D624,202 | S | 9/2010 | Thomassen et al. | |
| D624,203 | S | 9/2010 | Thomassen et al. | |
| 7,811,027 | B2 | 10/2010 | Scheiwiller | |
| 7,850,393 | B2 | 12/2010 | Hamel | |
| D640,800 | S | 6/2011 | Thomassen | |
| D643,544 | S | 8/2011 | Thomassen | |
| 7,988,382 | B2 | 8/2011 | Castonguay | |
| 7,993,718 | B2 | 8/2011 | Riccobene | |
| D645,573 | S | 9/2011 | Dallaire et al. | |
| D645,574 | S | 9/2011 | Thomassen | |
| 8,011,152 | B2 * | 9/2011 | Thomassen | E01C 5/06 404/29 |
| D646,600 | S | 10/2011 | Minkkinen | |
| 8,132,981 | B2 | 3/2012 | Castonguay et al. | |
| D660,982 | S | 5/2012 | Thomassen | |
| D664,677 | S | 7/2012 | Riccobene | |
| 8,226,323 | B2 | 7/2012 | Bouchard et al. | |
| 8,282,311 | B2 | 10/2012 | Chow | |
| 8,298,641 | B2 | 10/2012 | Riccobene | |
| 8,337,116 | B2 | 12/2012 | Castonguay et al. | |
| 8,413,397 | B2 | 4/2013 | Lacas et al. | |
| 8,500,361 | B2 | 8/2013 | Castonguay et al. | |
| D695,915 | S | 12/2013 | Dignard et al. | |
| D695,916 | S | 12/2013 | Dignard et al. | |
| D695,917 | S | 12/2013 | Dignard et al. | |
| D695,918 | S | 12/2013 | Dignard et al. | |
| D695,919 | S | 12/2013 | Dignard et al. | |
| D695,920 | S | 12/2013 | Dignard | |
| D695,921 | S | 12/2013 | Dignard | |
| D695,922 | S | 12/2013 | Dignard | |
| 8,609,215 | B2 | 12/2013 | Riccobene | |
| 8,616,803 | B2 | 12/2013 | Gebhart | |
| 8,667,752 | B2 | 3/2014 | Pollack | |
| 8,668,404 | B2 | 3/2014 | Bouchard et al. | |
| 8,747,019 | B2 | 6/2014 | Castonguay et al. | |
| 8,769,896 | B2 | 7/2014 | Lacas et al. | |
| 8,967,907 | B2 | 3/2015 | Castonguay et al. | |
| 9,057,197 | B2 | 6/2015 | Lacas et al. | |
| 9,193,215 | B2 | 11/2015 | Castonguay et al. | |
| 9,315,950 | B2 | 4/2016 | Browning et al. | |
| 2003/0007834 | A1 | 1/2003 | Bolduc et al. | |
| 2004/0163353 | A1 * | 8/2004 | Dean | E04C 1/395 52/608 |
| 2007/0077387 | A1 | 4/2007 | Riccobene | |
| 2007/0217865 | A1 * | 9/2007 | Castonguay | E01C 5/00 404/41 |
| 2008/0095577 | A1 | 4/2008 | Brun | |
| 2008/0101860 | A1 | 5/2008 | Scheiwiller | |
| 2008/0209828 | A1 | 9/2008 | Riccobene | |
| 2008/0240857 | A1 * | 10/2008 | Ciccarello | E01C 5/06 404/41 |
| 2009/0097916 | A1 | 4/2009 | Schroder | |
| 2010/0162648 | A1 * | 7/2010 | Thomassen | E01C 5/06 52/311.2 |
| 2010/0236174 | A1 | 9/2010 | Castonguay et al. | |
| 2010/0307092 | A1 * | 12/2010 | Bouchard | B44C 1/28 52/311.1 |
| 2011/0067333 | A1 * | 3/2011 | Lacas | B44C 5/06 52/311.1 |
| 2011/0293873 | A1 * | 12/2011 | Riccobene | B44C 3/123 428/44 |
| 2012/0003040 | A1 | 1/2012 | Castonguay et al. | |
| 2012/0057933 | A1 | 3/2012 | Gebhart | |
| 2012/0189386 | A1 | 7/2012 | Castonguay et al. | |
| 2012/0247050 | A1 | 10/2012 | Bouchard et al. | |
| 2013/0017016 | A1 | 1/2013 | Castonguay et al. | |
| 2013/0259569 | A1 | 10/2013 | Castonguay et al. | |
| 2013/0263543 | A1 | 10/2013 | Lacas et al. | |
| 2013/0302088 | A1 | 11/2013 | Penshorn | |
| 2014/0047788 | A1 | 2/2014 | Riccobene | |
| 2014/0112715 | A1 | 4/2014 | Browning et al. | |
| 2014/0169878 | A1 | 6/2014 | MacDonald | |
| 2014/0205807 | A1 | 7/2014 | Lacas et al. | |
| 2014/0241799 | A1 | 8/2014 | Castonguay et al. | |
| 2014/0260059 | A1 * | 9/2014 | Riccobene | E04B 2/08 52/588.1 |
| 2015/0104588 | A1 | 4/2015 | Castonguay et al. | |
| 2015/0176224 | A1 | 6/2015 | Dignard et al. | |
| 2016/0222595 | A1 | 8/2016 | Browning et al. | |

FOREIGN PATENT DOCUMENTS

| | | | |
|---|---|---|---|
| CA | 2083215 | | 5/1994 |
| CA | 2519296 | | 10/2004 |
| CA | 2569998 | | 5/2006 |
| CA | 2616200 | | 4/2008 |
| CA | 2582987 | A1 | 9/2008 |
| CH | 562921 | | 6/1975 |
| DE | 7122262 | | 11/1971 |
| DE | 3533020 | | 3/1987 |
| DE | 9211118 | | 3/1993 |
| DE | 4232300 | | 3/1994 |
| DE | 4333942 | | 4/1995 |
| DE | 19747421 | | 4/1999 |
| DE | 19937639 | | 2/2000 |
| DE | 29922003 | | 2/2000 |
| DE | 10001967 | | 7/2001 |
| DE | 20101214 | | 5/2002 |
| EP | 0424592 | | 5/1991 |
| EP | 0666372 | A1 | 8/1995 |
| FR | 2354416 | | 1/1978 |
| GB | 1094632 | | 12/1967 |
| GB | DES. 1047163 | | 12/1987 |
| GB | 2208883 | | 4/1989 |
| GB | 2214206 | | 8/1989 |
| JP | 2002/285504 | | 10/2002 |
| JP | 1180760 | | 6/2003 |
| JP | 1180761 | | 6/2003 |
| JP | 1180860 | | 6/2003 |
| JP | 1180861 | | 6/2003 |
| JP | 2004-124634 | | 4/2004 |
| JP | 3640654 | | 1/2005 |
| JP | 2008169636 | A | 7/2008 |
| NL | 7415523 | | 6/1976 |
| SE | DES. 44357 | | 10/1988 |
| WO | 94/15025 | | 7/1994 |
| WO | 2001044578 | | 6/2001 |
| WO | 01/53612 | | 7/2001 |
| WO | 02059423 | A1 | 8/2002 |
| WO | 2002059423 | | 8/2002 |
| WO | 02/89934 | | 11/2002 |
| WO | 2002095133 | | 11/2002 |
| WO | 2005084900 | | 9/2005 |
| WO | 2006045192 | | 5/2006 |
| WO | 2006045192 | A1 | 5/2006 |
| WO | 2009039617 | | 4/2009 |

(56) References Cited

FOREIGN PATENT DOCUMENTS

| | | |
|---|---|---|
| WO | 2009140760 | 11/2009 |
| WO | 2009140760 A1 | 11/2009 |

OTHER PUBLICATIONS

Lawrence, Backyard Brickwork, 1989, p. 76, Garden Way Publishing, Pownal, VT, U.S.A.
Fitzgerrell, Basic Masomy Illustrated, a Sunset Book, 1981, pp. 76-77, Lane Publishing Co., Menlo Park, CA, U.S.A.
Bomanite Corp.—Leadership a Reputation for Excellence, Innovation & Experience, 1994, Bomanite International Society, Madera, CA, U.S.A., 5 sheets of literature, available at least as early as Oct. 24, 2004.
Brickform Patterns—1 Sheet, 1994.
Brickform Texture Mats—2 Sheets, 1988.
Brickform Tools—Texture Mats—4 Sheets, available at least as early as Oct. 24, 2004, 4 sheets.
Color Tile Advertisement, Royal Rock Ceramic Tile, Jan. 14, 1990, Houston Post, Houston, TX, U.S.A.
Creative Impressions, Ltd., Export Price List and Drawings, Apr. 1990, U.K.
Exhibit G—Photocopy of Front of Color Tile Royal Rock Ceramic Tile, available at least as early as Oct. 24, 2004.
Exhibit H—Photocopy of Rear of Color Tile Royal Rock Ceramic Tile, available at least as early as Oct. 24, 2004.
Decristoforo, Handyman's Guide to Concrete and Masonry, 1978, pp. 183-189, Reston Publishing Co., Inc., Reston, VA, U.S.A.
Decristoforo, Handyman's Guide to Concrete and Masomy Handbook, 1960, p. 70, Arco Publishing Co., Inc., New York City, NY, U.S.A.
Lasting Impressions in Concrete, Inc., Undated, CA, U.S.A., available at least as early as Oct. 24, 2004, 6 sheets of literature.
Patterned Concrete Industries, Inc., Specifications, Undated, Houston, TX, U.S.A., available at least as early as Oct. 24, 2004, 3 sheets.
Sweet's Catalog, vol. 2 Bomacron Patterns, 1994.
Sweets General Building and Renovation, 1993 Catalog File, p. 11, Anchor Buyline 6518, 04200/ANC.
Duncan, The Complete Book of Outdoor Masonry, 1977, pp. 342-345, TAB Books, Blue Ridge Summit, PA, U.S.A.
Uni-Group U.S.A.—Manufacture of Uni Paving Stones The Original. The Best., 1992, Palm Beach Gardens, FL, U.S.A.
Grunbaum, B. and Shephard, G.C., "Tilings and Patterns," 1987, pp. 288-290, 510 W.H. Freeman and Company, New York, N.Y.
"Landscapes Become Dreamscapes," Pavestone Company, 2003, 2 pages.
Neolithics Masonry Design, www.neolithicsusa.com, Nov. 2003, 3 pages.
Author: Jinny Beyer, Designing Tessellatins: The Secrets of Interlocking Patterns, Chapter 7: The Keys to creating Interlocking Tessellations: pp. 1-7, 16-17 and 125-165, 1999.
Nature Walk™ Natural Flagstone Appeal for Pedestrian Traffic, 2001, 4 pages.
Website: www.sf-kooperation.de/english/index—Pentalith, Canteon, Jul. 2001, 3 pages.
Website:www.sf-kooperation.de/english/index—Canteon®; CIS 300-10; Pentalith, Sep. 2003, 5 pages.
Retaining Walls, Pavestone Brochure, published 2002, 6 pages.
Concrete Landscaping/Products, Oldcastle Brochure, published 2002, 12 pages.
Website: www.mathforum.org/sum95/suzanne/whattess.html—What is Tessellation?—dated Apr. 24, 2002, 4 pages.
Beautiful Edgers, Pavestone Brochure, published 2002, 5 pages.
Website: www.superstone.com—Split Rock, Dec. 2002, 1 page.
Website: www.matcrete.net/RandomStone.htm—MATCRETE The Ultimate in Concrete Design, Dec. 2002, 1 page.
Patio Dreamscapes, Pavestone Brochure; Sandstone System, published 2003, 5 pages.
Landscaping Stones, Mat Stone Brochure, Nature Walk, Garden Walk, published 2003, 2 pages.
Paving Stone Dreamscapes, Pavestone Brochure, published 2003, 13 pages.
Website: www.geckostone.com—GECKOSTONE™,Mar. 2003, 4 pages.
Website: www.learningcompanyschool.com—TesselMania! Deluxe, Jun. 2003, 3 pages.
Website: riverdeep.net/products/other/tesselmaniajhtml—TesselMania!, Jun. 2003, 4 pages.
International Search Report and Written Opinion in related International Application No. PCT/CA2013/050463, dated Sep. 6, 2013, 8 pages.

* cited by examiner

DUAL-UNIT PAVING SYSTEM

CROSS-REFERENCE TO RELATED APPLICATION

This application is a continuation of U.S. application Ser. No. 15/688,023, filed on Aug. 28, 2017, which is a continuation of U.S. application Ser. No. 15/195,877, filed on Jun. 28, 2016, which issued on Sep. 5, 2017 as U.S. Pat. No. 9,752,288, which is a continuation of Ser. No. 14/409,169, filed on Dec. 18, 2014, which issued on Aug. 2, 2016 as U.S. Pat. No. 9,404,226, which is the U.S. national phase of International Application No. PCT/CA2013/050463 filed on Jun. 17, 2013, and published on Dec. 27, 2013 as International Publication No. WO 2013/188971 A1, which application claims priority to and the benefit of U.S. Provisional Application No. 61/661,008, filed on Jun. 18, 2012, the contents of all which are incorporated herein by reference in their entireties.

FIELD OF THE INVENTION

The present invention relates generally to the field of paving units and artificial stones or flagstones for laying out pavements and is more particularly directed to such stones giving the resulting pavement a random and natural-looking appearance.

BACKGROUND OF THE INVENTION

Artificial covering units made of concrete are well-known to lay out pavements or covering wall surfaces on residential or commercial properties, for example defining the surface of walkways or patios. Such stones are advantageously relatively inexpensive to make, as opposed to natural carved flagstones, but the resulting pattern is often repetitive or has what is called in this field an unnatural "linear line effect". Great efforts have been made to design artificial covering units which provide a more natural look, while still retaining the ease in their manufacture. It is worth mentioning that the expressions "covering unit", "stone" and "flagstone" are used throughout the present description without distinction to define a unit used as a paving or as a building material.

Attempts have been made in the past to develop sets of artificial stones comprising stones of different shapes used in combination with each other for paving a surface. The natural random look in those cases is obtained by combining artificial stones of different shapes. However a major drawback with those sets is that they often become a real puzzle for the user to install and combine the stones in a proper way. Another drawback is that currently existing systems are limited in terms of possible types of installation. Most systems allow installation of the units according to either one of the rotational or the linear tessellation principle, but few offer the possibility of installing the units by rotation or linearly (by "running bond" or "stack bond").

There is currently a need in the market for larger artificial stones, since they tend to provide a more natural and esthetic look. Larger artificial stones also provide better coverage per unit. However, one drawback of larger stones is that they are also generally heavier.

Known to the Applicant is U.S. Pat. No. 7,637,688, which describes a building unit made of primary elements which are rotational tessellation of one another. Since the building units are all based on a primary element, pavements created with such units tend to have a discernible pattern.

Also known to the Applicant is U.S. design Pat. No. D602,173. This design shows two units which can be paired to form a hexagonal shape. While the paired units allow the creation of pavement with a rotational tessellation, it does not allow assemble the units in a stack bond or running bond configurations.

Thus, there is presently a need for a paving system that provides a natural random look, while at the same time being easy to manufacture at a reasonable cost, and easy to install for any unskilled person in either one of linear and rotational tessellations.

SUMMARY OF THE INVENTION

Hence, in light of the aforementioned, there is a need for a paving system including units for use in combination with other units for covering a surface with a natural random look, which by virtue of their design and components, would be able to overcome some of the above-discussed concerns.

In accordance with the present invention, there is provided a dual-unit paving system for covering a surface. The system comprises pairs of first and second units. For each pair, the first unit has a lower face for facing the ground, an exposed upper face, and sidewalls extending from the lower face. The sidewalls of the first unit include a top side, a bottom side, a left side and a right side.

The second unit has a lower face for facing the ground, an exposed upper face and sidewalls extending from the lower face. The sidewalls of the second unit include a top side, a bottom side, a left side and a right side.

The bottom side of the first unit has a non-linear, irregular outline matingly engageable with an outline of the top side of the second unit for forming a hexagonal assembly. The hexagonal assembly formed by units A and B has six non-linear sides. This hexagonal assembly allows to form rotational tessellations.

The left side and the right side of the second unit have non-linear, irregular outlines matingly engageable to at least respective portions of outlines of the right side and left side of the first unit.

The outline of the bottom side of the first unit comprises the outline of the top side of the first unit and the outline of the top side of the second unit comprises the outline of the bottom side of the second unit, for forming linear assemblies.

The first and second units forming the paving system can be installed either by rotational tessellation or by linear tessellation.

In one embodiment, the first and second units of a pair are created by dividing a corresponding hexagonal shape along an irregular separation line extending proximate the first vertex towards a location proximate the fourth vertex.

In one embodiment, the separation line delimiting the first and the second units includes a segment which is parallel and substantially similar to the outline of the side extending between the second and third vertices of the module. The separation line can be obtained by performing a linear transposition of the top segment of the first unit. The first unit includes the second and third vertices and a top side having an outline corresponding to the separation line. The second unit includes the fifth and sixth vertices and a bottom side having an outline corresponding to the separation line.

In one embodiment, for each paving module, the first side is concave and the second side is convex.

In one embodiment, the separation line extends from a location between the first and sixth vertex, closer to the first vertex, to a location between the fourth and fifth vertex, closer to the fourth vertex of an hexagonal assembly.

In one embodiment, each of the first and second units of a paving module comprises a top and a bottom side, and second unit being shaped such that when laid over the first unit, the top and bottom sides of the second unit coincide with the top and bottom sides of the first unit.

In one embodiment, the first and second units are provided with respective top faces, said top faces including at least two patterns of a flagstone, the patterns of the first unit differing from the patterns of the second unit. Preferably, the patterns are delimited by deep joints.

In one embodiment, the dual-unit paving system includes at least two groups of two first units and two second units, as defined above. In this paving system, the top face of the first unit differs from the top face of the first unit. Similarly, the top face of the second unit differs from the top face of the second unit. The paving system thereby allows the creation of four or more different paving modules, each module having a distinct top face.

In one embodiment, the paving system includes several groups of paired modules. The first and second units of the paving system can be installed linearly, by alternating the first and second modules.

The paving system according to the invention can advantageously be used for creating patio, pathways, sidewalks or stepping stones.

The present invention is also very advantageous for the manufacturer. The first and second unit of the paving system can be placed either one facing the other or side by side, thus optimizing the clamping operation during the manufacturing process.

Advantageously, the paving units can be assembled and installed either by rotational tessellation or by linear tessellation, with little or no "linear effect". Advantageously, with a paving system including two groups of first and second units as defined above, twelve different module configurations can be created when the units are installed according to the rotational tessellation principle. By using two different units matable with one another into a paving module, a multitude of different designs can be created, either by rotational or linear tessalation, in stack or running bond configurations.

BRIEF DESCRIPTION OF THE DRAWINGS

Other objects, advantages and features of the present invention will become more apparent upon reading the following non-restrictive description of preferred embodiments thereof, given for the purpose of exemplification only, with reference to the accompanying drawings in which:

FIGS. 12 and 13 show a pavement according to a stack bond configuration.

FIG. 14 shows a pavement according to a running bond configuration.

DESCRIPTION OF PREFERRED EMBODIMENTS

Figure 1:
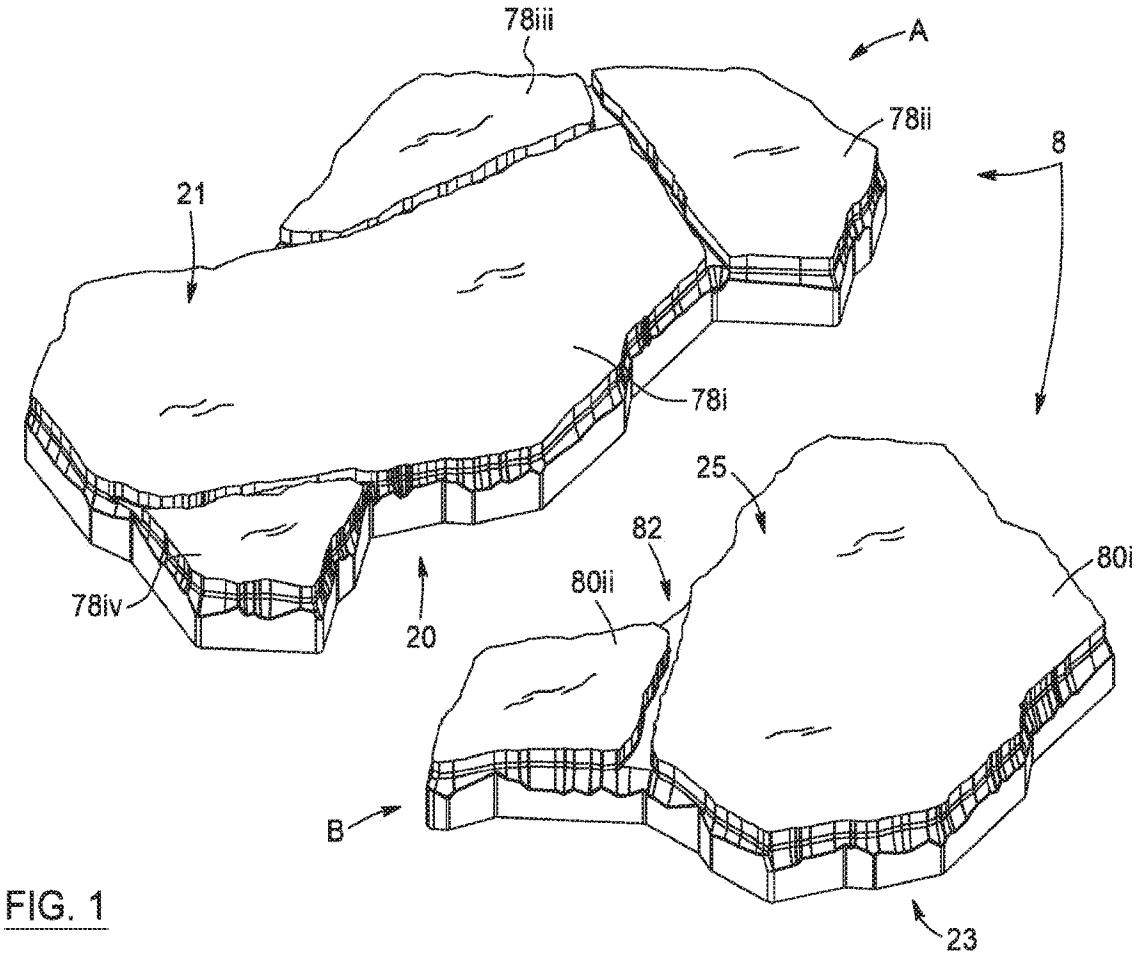
FIG. 1 is a perspective view of a dual-unit paving system, according to an embodiment.

In the following description, similar features in the drawings have been given similar reference numerals. In order to preserve clarity, certain elements may not be identified in some figures if they are already identified in a previous figure.

It will be appreciated that positional descriptions such as "lower", "upper", "vertical", "horizontal", "top", "bottom", "side" and the like should, unless otherwise indicated, be taken in the context of the figures and should not be considered limiting or as implying a required orientation during use.

The dual-unit paving system advantageously allows the creation of different assemblies, according to linear or rotational tessellations. With only two different shapes of units, the system can provide the illusion of having been assembled randomly and created from natural flagstones. The present paving system also provides units which are as large as possible while remaining easy to install in different configurations. By "tessellation" it is meant a covering, tiling or paving of one or more shapes to cover a surface, without any substantial gaps between shapes.

Referring to FIG. 1, a first unit A and a second unit B are shown. They form a pair of units A, B of a dual-unit paving system 8, for covering a surface. The first unit A has a lower face 20 for facing the ground, an exposed upper face 21, and sidewalls extending from the lower face 20. The second unit B also has a lower face 23 for facing the ground, an exposed upper face 25 and sidewalls extending from the lower face 23.

Preferably, the upper exposed face 21, 25 of at least one of the first and second units A, B includes two or more different patterns 78*i* to 78*iv* and 80*i*, 80*i*, which are preferably flagstone patterns. The patterns are preferably all different, so as to increase the randomness aspect of pavements created with the dual-unit paving system. The flagstones patterns are preferably delimited by deep joints 82.

Figure 2A:
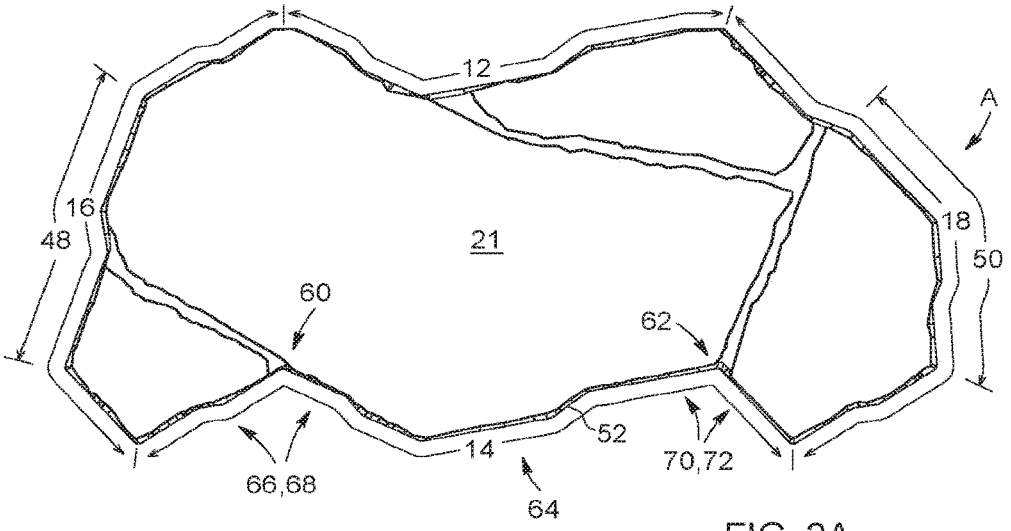
FIG. 2A is a top plan view of the first unit of the paving system of FIG. 1.

FIG. 2A is a top view of unit A. The sidewalls of unit A include a top side 12, a bottom side 14, a left side 16 and a right side 18. The terms "top", "bottom", "left" and "right" refer here to the orientation of the sides of unit as shown in FIG. 2, which also corresponds to the orientation of the sides when looking at the unit over its upper, exposed face, such as when the unit is placed on the ground and one is looking at the unit directly over it. The terms "top", "bottom", "right' and "left" are used to facilitate and simplify reference to the different sides of the unit, and they could be referred as "first", "second", "third" and "fourth" sides as well.

The outline of each side 12, 14, 16, 18 is made of several segments at angle from one another. The outline of the sides is non-linear and irregular. By "irregular" it is meant that the sides include several segments and split deviations. Toward the lower face of the unit, the sides are made of several flat surfaces. The junction of the upper exposed face 21 of the unit with the sides is chiselled, so as to imitate natural carved stone.

Figure 2B:
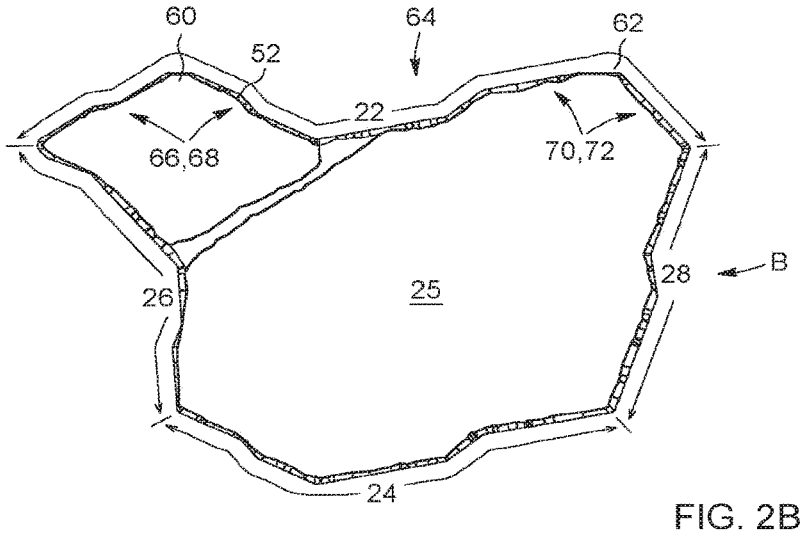
FIG. 2B is a top plan view of the second unit of the paving system of FIG. 1.

FIG. 2B is a top view of unit B. The sidewalls of unit B also include a top side 22, a bottom side 24, a left side 26 and a left side 28. The outline of each side is made of several angled segments. Similar to unit A, each side of unit B is made of several intersecting flat surfaces toward the lower face of the unit B and the junction of the sides with the upper exposed face 25 of the unit is chiselled. The different patterns can be colored and given a texture to imitate natural flagstones.

Figure 3:
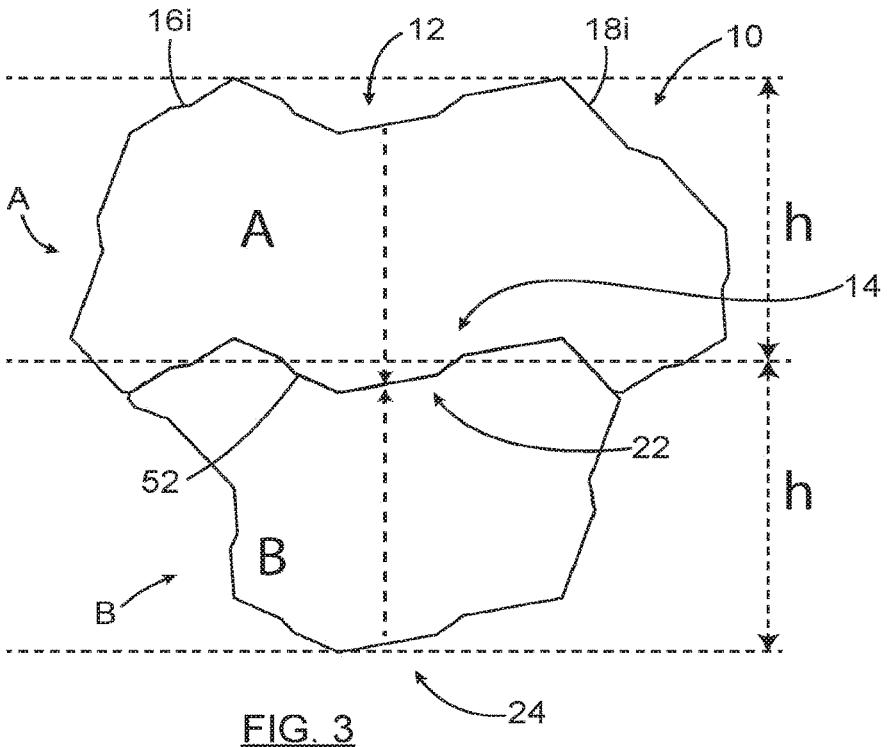
FIG. 3 is a schematic top view of the first and second units of the dual-unit paving system of FIG. 1, facing one another and forming a hexagonal assembly, according to an embodiment.

Referring to FIGS. 2A and 2B, and also to FIG. 3, the bottom side 14 of the first unit A has a non-linear, irregular outline matingly engageable with the outline of the top side 22 of the second unit B. By "matingly engageable", it is meant that the units can be assembled or paired, so that sides will closely fit one another. When units A and B are assembled so as to face one another, as shown in FIG. 3, they form a hexagonal assembly 10 having six, non-linear sides. By "hexagonal" it is meant that the shape is reminiscent of a hexagon. The hexagonal assembly has an hexagon-based shape, with six sides and six angles.

Still referring to FIG. 3, in this particular embodiment of the second unit B, the outline of the top side 22 includes a portion which corresponds to a vertical translation of the outline of the bottom side 24. This feature is also present in unit A, for which the outline of the bottom side 14 includes a portion which corresponds to a vertical translation of the outline of the top side 12. It will also be appreciated that preferably, the outline of the top side 12 of the first unit A and adjacent segments 16*i*, 18*i* of the left and right sides 16, 18 correspond to a vertical translation of the outline of the bottom side 14 of the first unit A. By "vertical" translation it is meant that the translation is made substantially perpendicularly relative to the sides.

Figure 3A:
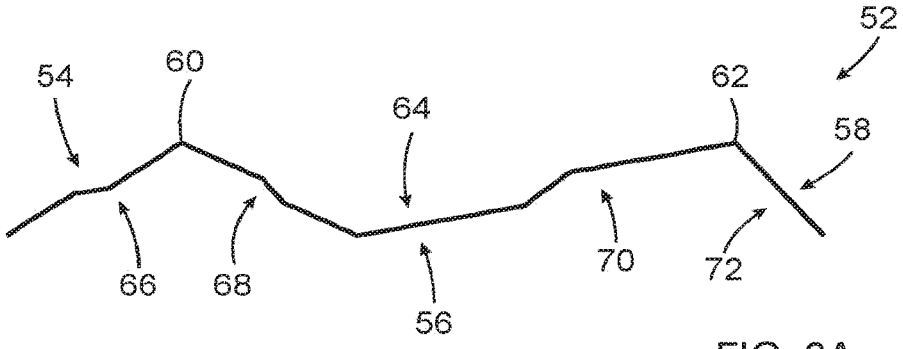
FIG. 3A is a top view of the outline of the bottom side of the first unit or of the outline of the top side of the second unit, according to an embodiment of the invention.

Still referring to FIG. 3 and also to FIG. 3A, the respective outlines of the top side 22 of the second unit B and of the bottom side 14 of the first unit A are preferably similar, and are referred to as a separation outline 52.

In this particular embodiment, the separation outline 52 includes two outer portions 54, 58 and one inner portion 56. This portion 56 has an outline similar to the bottom side 24 of the second unit B. Preferably, at least one of the outer and inner portions are formed by several non-linear segments, such as for portions 54 or 56 of the separation line. Still preferably, the separation line has two summits 60, 62 and a valley 64 between the two summits 60, 62. In this embodiment, summit 60 has a first segment and a second segments 66, 68 extending from it, the first segment 66 being a rotational image of the second segment 68. Similarly, summit 62 has first and second segments 70, 72 being rotational images of one another.

Still referring to FIG. 3, it is preferable that the units A and B have approximately the same height h. This height h is measured on unit A from the highest point on side 12 to the highest point of side 14. Similarly, the height h of unit B is measured from the highest point on side 22 to the highest point of side 24. Of course, the term "highest" is to be taken in the context of the Figures, and relates to a vertical or "Y" axis.

Referring to FIGS. 3 and 3A, as can be appreciated, the first and second units A and B are formed by dividing the hexagonal shape 10 in two different and distinct units A and B. The separation line 52 used for forming the units A, B is located approximately halfway between the highest point and the lowest point of the hexagonal assembly 10. The separation line 52 includes within its profile a portion of the perimeter of the hexagonal outline, transposed or translated linearly along a central axis of the assembly 10. It will also be noted that the inner portion 56 of the separation line 52 includes the outline of the sides of the hexagonal shape 10. The remaining portions 54, 58 of the separation line 52 also correspond to other sections of the outline of the hexagonal shape.

Figure 4A:
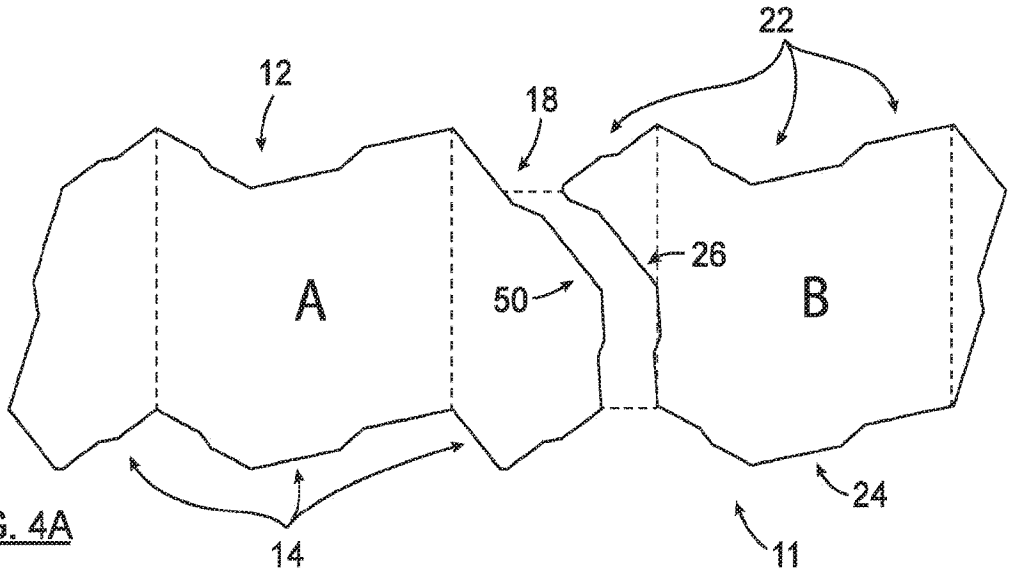
FIG. 4A is a schematic top view of the first and second units, placed side by side in first linear assembly.
Figure 4B:
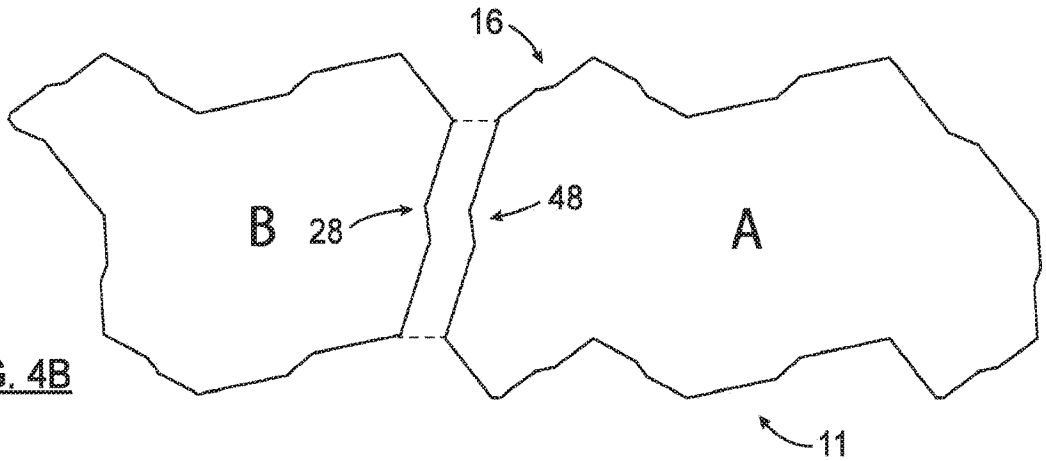
FIG. 4B is schematic top view of the first and second units, placed side by side in a second linear assembly.

Referring to FIGS. 4A and 4B, two different linear assemblies 11 are shown. As can be appreciated, the left side 26 and the right side 28 of the second unit B have non-linear, irregular outlines matingly engageable to at least respective portions 50, 48 of the outlines of the right side 18 and left side 16 of the first unit A. For example, such linear assemblies 11 can be used to form pathways. In this case, the linear assemblies are oriented horizontally Referring to FIG. 4A, the outline of the bottom side 14 of the first unit A includes the outline of the top side 12 of the first unit A and the outline of the top side 22 of the second unit B includes the outline of the bottom side 24 of the second unit B. This allows the units to form linear assemblies along a vertical orientation as well. Units A can be stacked vertically, in a stack bond configuration, and so can units B.

Figure 10A:
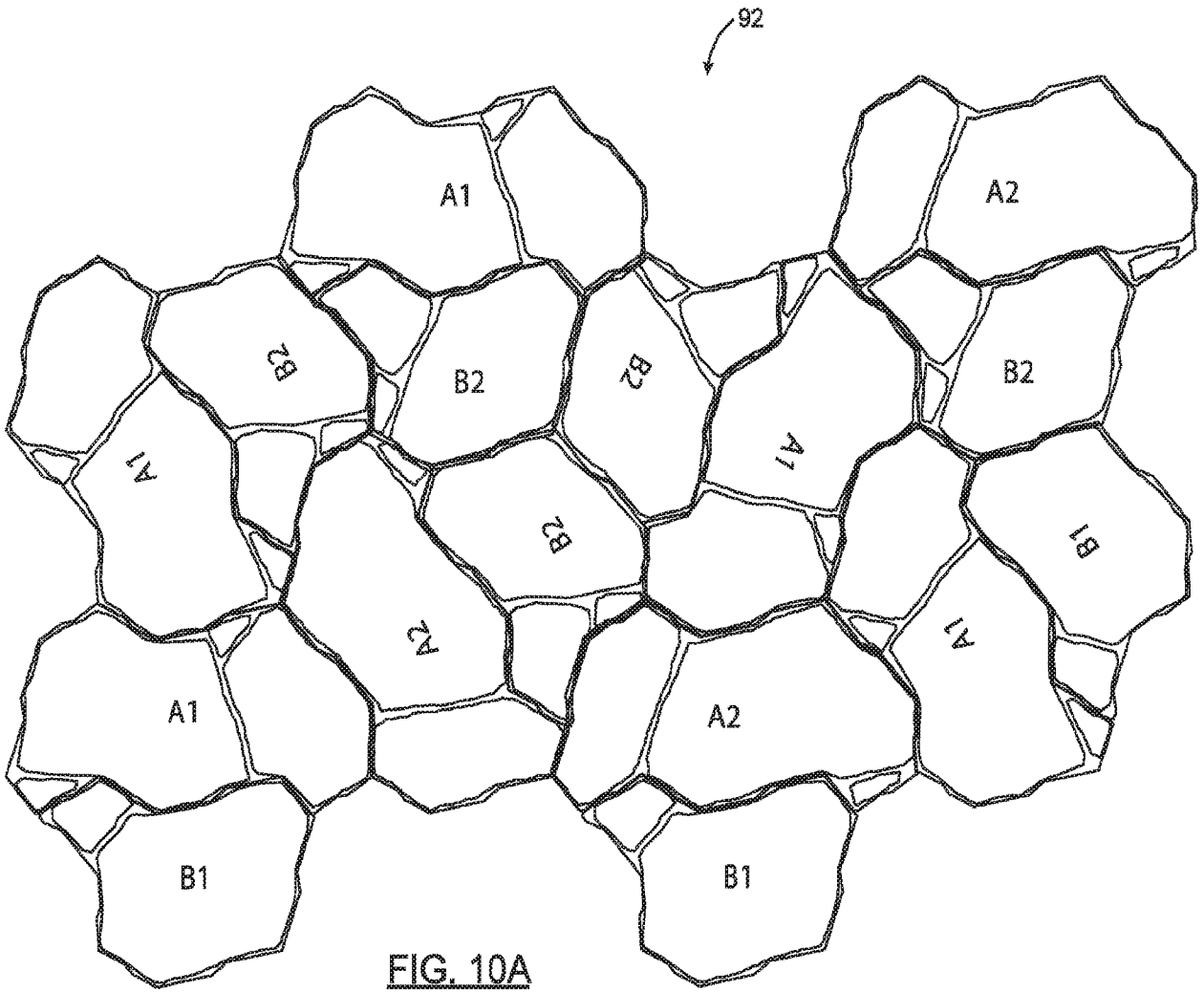
FIG. 10A are top views of another pavement made of different hexagonal assemblies placed in different orientations and shown assembled according to an embodiment of the invention.
Figure 10B:
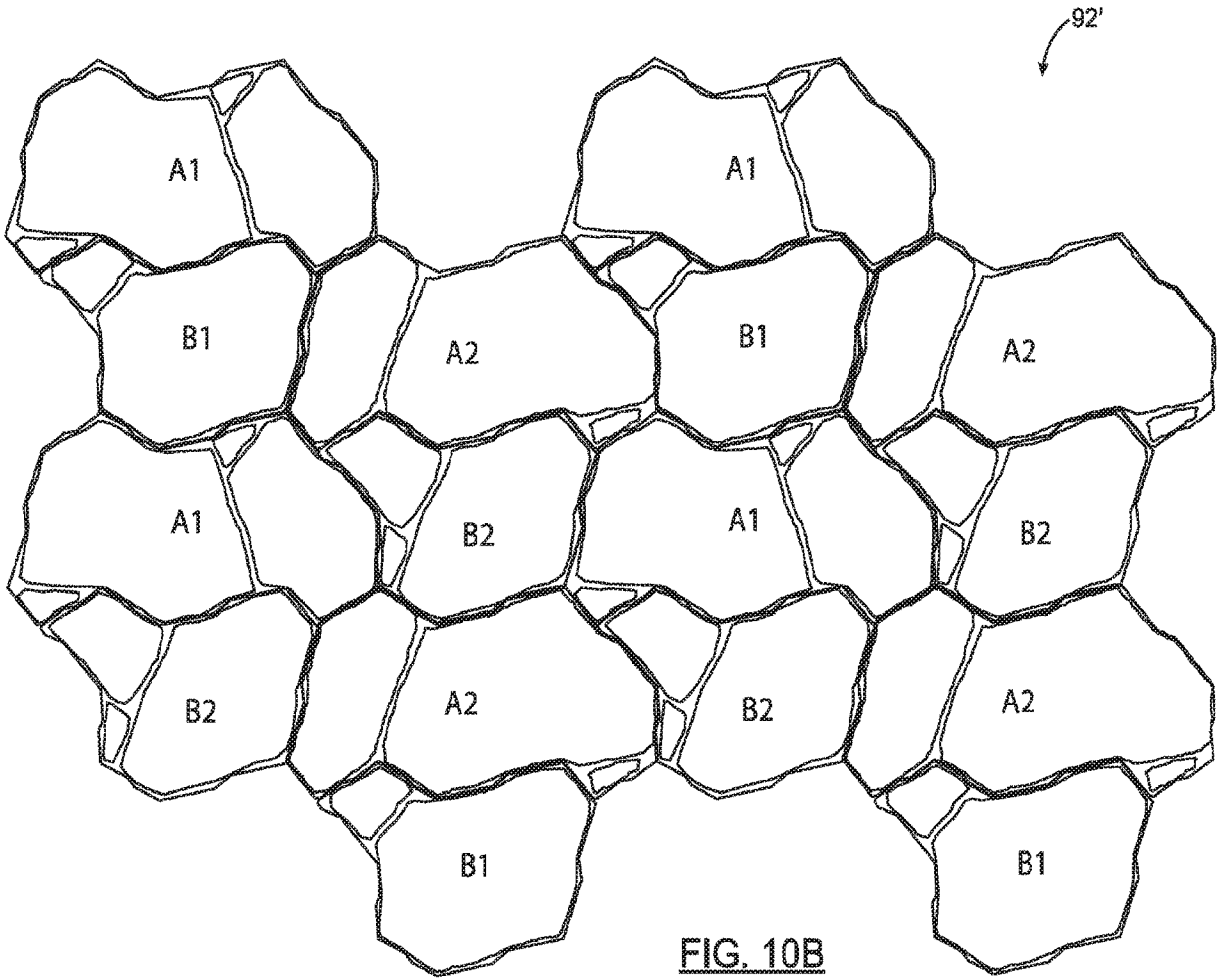
FIG. 10B is a top view of a pavement made from different hexagonal assemblies having the same orientation and shown assembled according to an embodiment of the invention.

In addition, the top side 12 of the first unit A is preferably substantially similar to the bottom side of 24 of the second unit B, so that hexagonal assemblies can be stacked vertically, such as shown in FIG. 10B.

Figure 5:
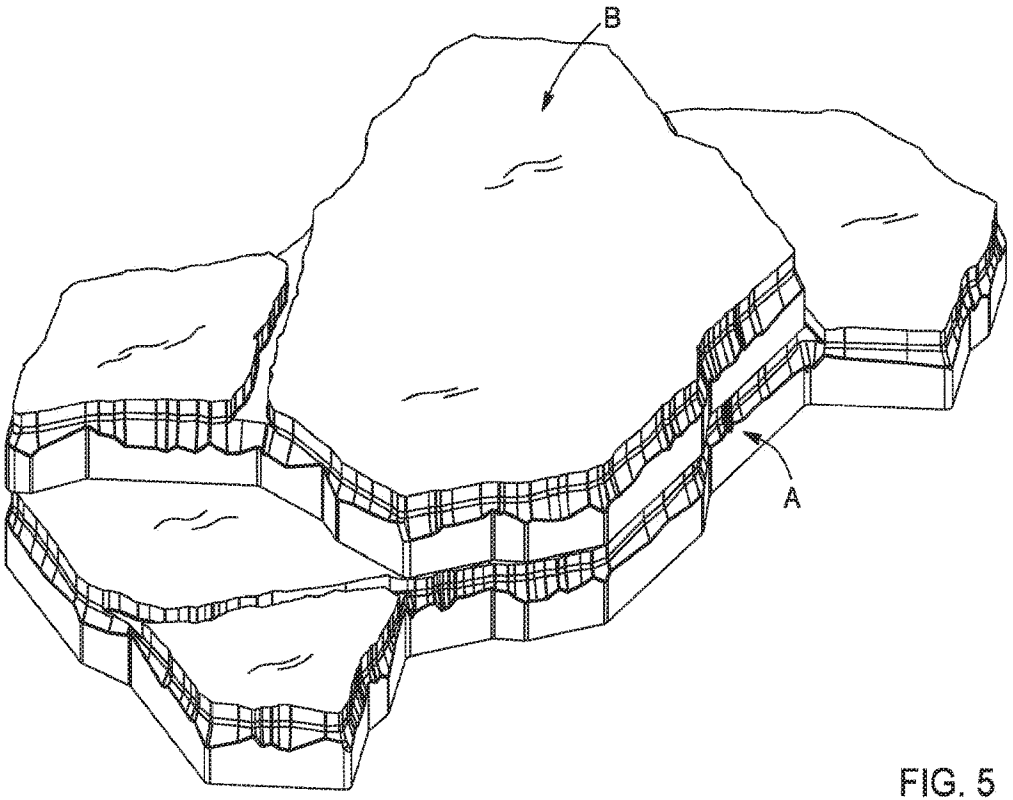
FIG. 5 is a perspective view of unit B being placed over unit A.
Figure 5A:
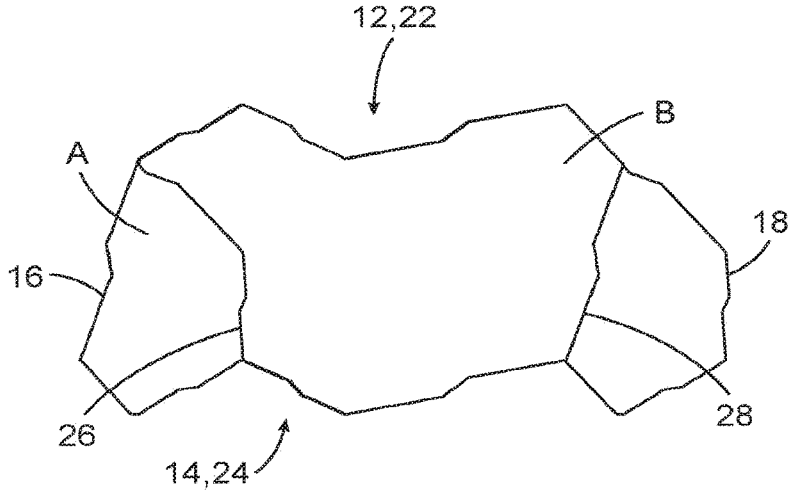
FIG. 5A is a top view of unit A placed over unit B.

Referring to FIGS. 5 and 5A, the second unit B is shaped such that when laid over the first unit A, the top and bottom sides 22, 24 of the second unit B coincide with the top and bottom sides 12, 14 of the first unit A. In other words, when the second paving unit B is placed over the first paving unit A, it fits perfectly within the outline of the first unit A. Both top and bottom sides of units A and B coincide with one another. Unit B is smaller in size than unit A. In other words, the top surface of unit B is smaller than the top surface of unit A. The volume and weight of unit B are also smaller than the volume and weight of unit A.

Figure 6A:
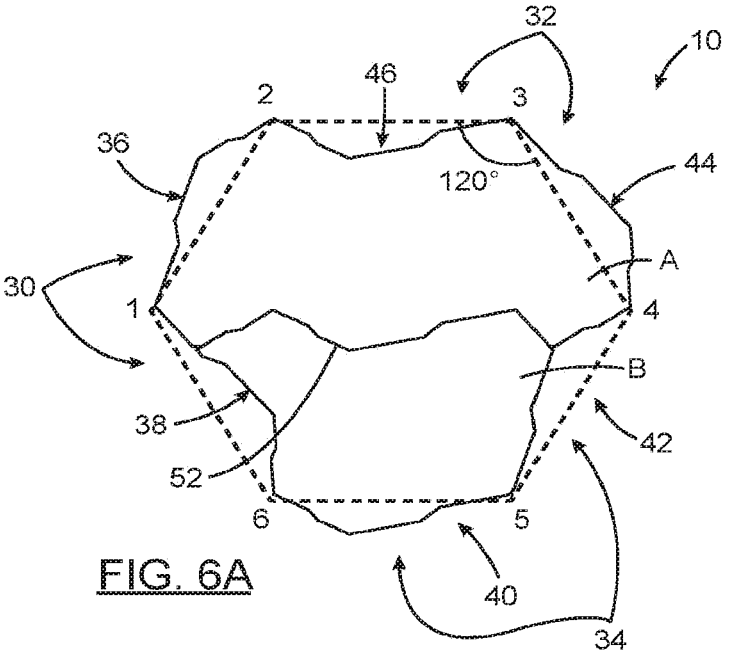
FIGS. 6A and 6B are schematic representations of the outer outline of the hexagonal assembly shown in FIG. 3.
Figure 6B:
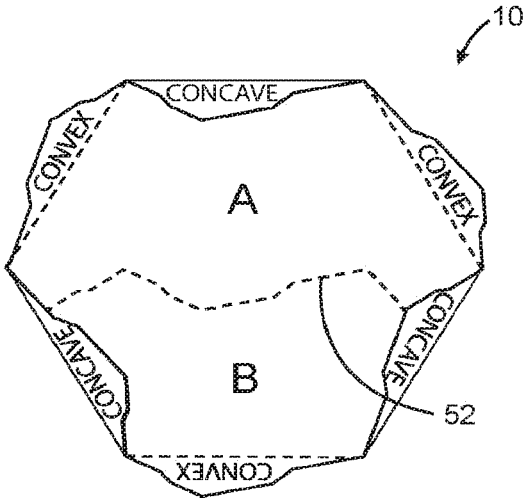

Referring now to FIGS. 6A and 6B, different aspects of the hexagonal assembly 10 formed by units A and B are shown. The outline of the hexagonal assembly 10 formed by units A and B has six sides 36, 38, 40, 42, 44 and 46. They form three pairs of sides 30, 32 and 34. The hexagonal assembly 10 has first 1, second 2, third 3, fourth 4, fifth 5 and sixth 6 consecutive vertices, and the separation outline 52 preferably extends from near the first vertex 1 to near the fourth vertex 4. It will be also noted that each of the sides of the hexagonal assembly 10 is formed by several segments at angle from one another, and the outline of a side does not include any repetitive portion or segment. This feature allows creating pavements with a more random, irregular aspect.

Adjacent sides of the hexagonal assembly preferably spaced apart by an angle of approximately 120°, and the six sides 36, 38, 40, 42, 44 and 46 are preferably congruent. By "congruent", it is meant that the sides are superposable, so as to be coincident throughout.

When the first and second units A, B are facing one another to form the hexagonal assembly 10, two adjacent sides of the hexagonal assembly preferably comprise a convex side 36, 40, 44 and a concave side 38, 42, 46. This characteristic allows the assemblies to interlock with one another when forming a pavement by rotational tessellation of such assemblies, and thus results in a more stable installation.

Figure 7A:
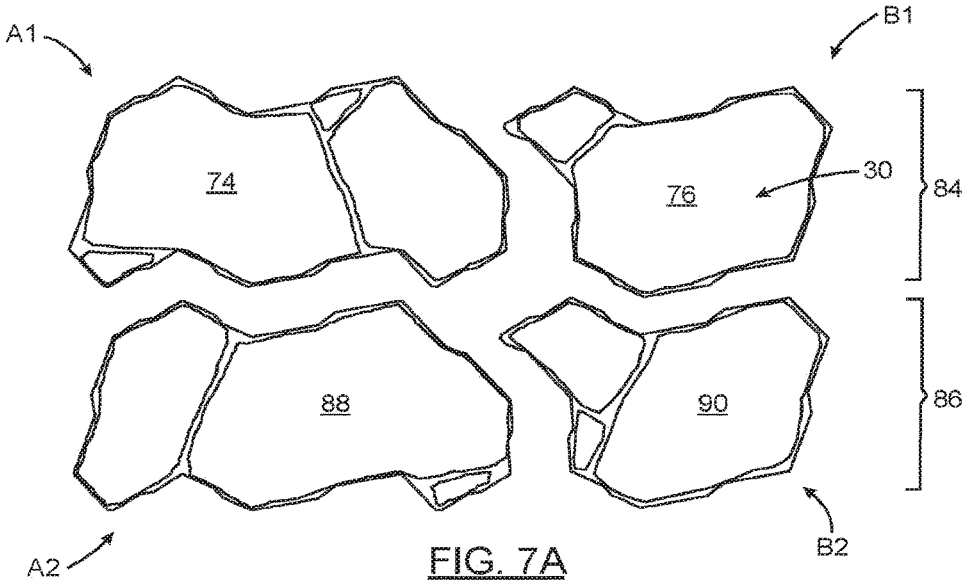
FIG. 7A is a top view of two groups of pairs of units, according to an embodiment.
Figure 7B:
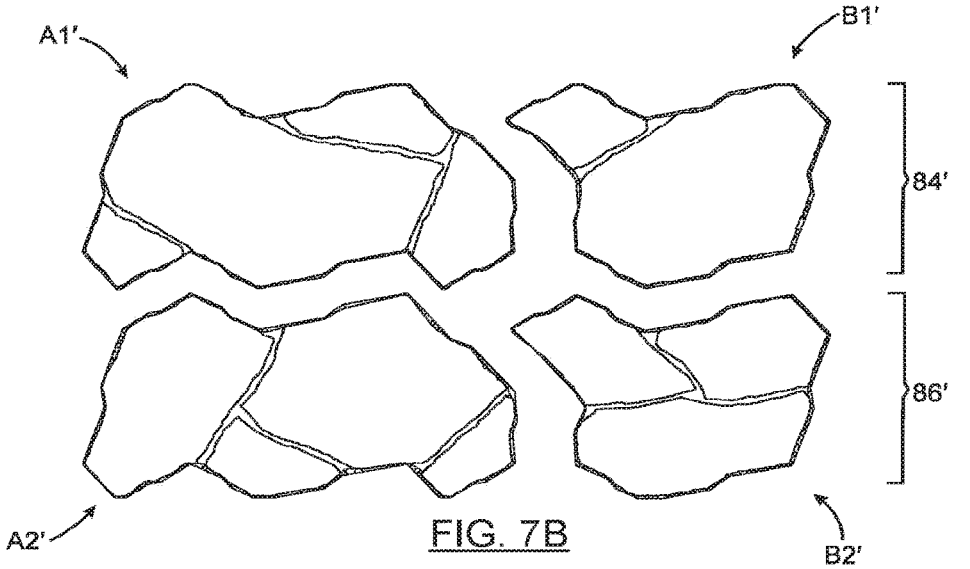
FIG. 7B is a top view of two groups of pairs of unit, according to another embodiment.

Referring now to FIGS. 7A and 7B, pairs of units A, B are preferably divided into first 84, 84' and second 86, 86' groups. In FIG. 7A, the upper faces 74 of the first unit A1 differs from the upper face 88 of the first unit A2. Similarly, the upper face 76 of the second unit B1 differs from the upper face 90 of the second unit B2. Of course, in other embodiments of the invention, the dual-unit paving system can include three or more groups of different pairs of units A, B. The number of different possible combinations PC is obtained by multiplying the number of first paving units (type A) by the number of second paving units (type B); and NbA×NbB=PC. Preferably, the surface area of the flagstone patterns of unit A is substantially similar to the surface area of either one of the exposed face of second unit B, or of one of the patterns of unit B.

Advantageously, the specific shape given to the units facilitates the "clamping" of the units, during the manufacturing of the units. During the manufacturing process, after unmolding and curing the units and prior to packaging them, the units must be clamped with large clamps and placed over pallets for wrapping. The specific configuration of the first and second units A and B allows to assemble them such that the space occupied by the units on the pallets is maximized, thus facilitating their handling.

Figure 8:
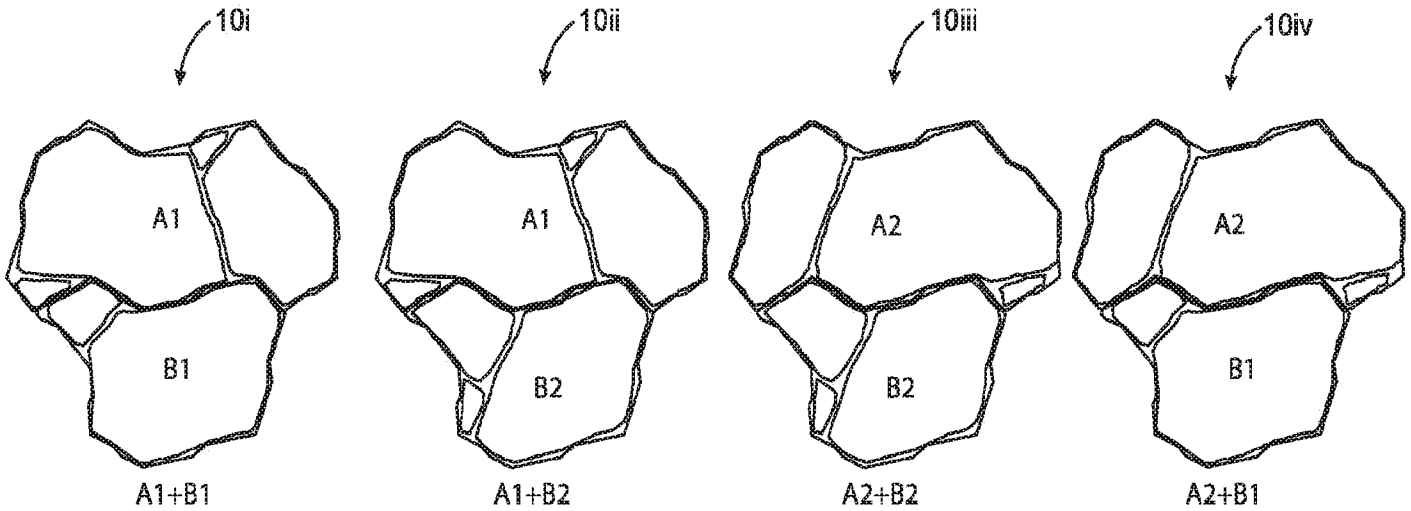
FIG. 8 is a top view of different configurations of hexagonal assemblies, according to an embodiment of the invention.

As shown in FIG. 8, this characteristic of the dual-unit paving system allows creating four different hexagonal assemblies 10*i*, 10*ii*, 10*iii*, 10*iv*. Each assembly has a distinct upper face appearance.

Figure 9:
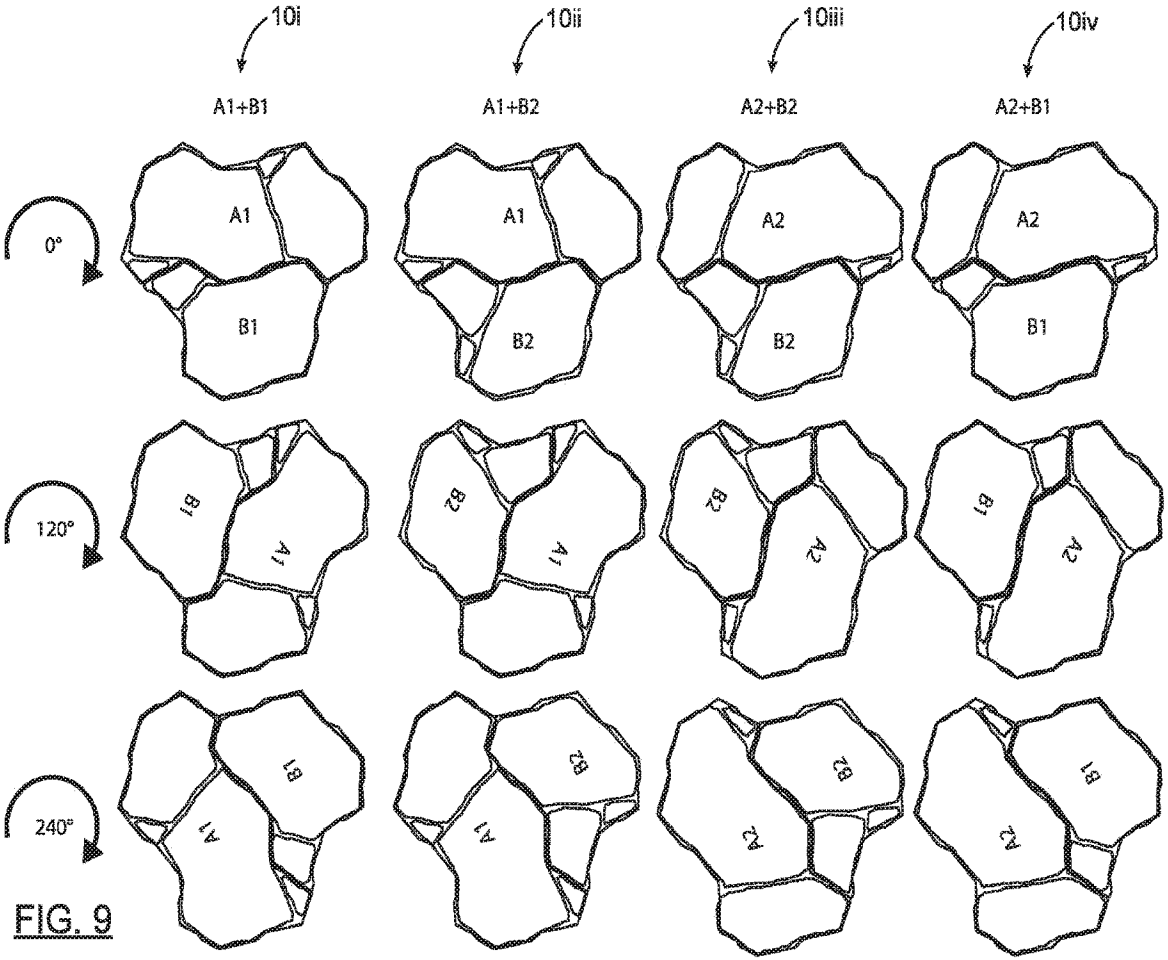
FIG. 9 is a top view of twelve different configurations of hexagonal assemblies.

Referring to FIG. 9, the four hexagonal assemblies 10*i*, 10*ii*, 10*iii* and 10*iv* can be positioned according to three different angles of rotation: 00, 120° and 240°. The dual-unit system thereby allows the creation of twelve different configurations of hexagonal assemblies.

As shown in FIG. 10A, a pavement 92 obtained by a rotational tessellation of different hexagonal assemblies obtained with units A1, B1, A2 and B2 has a random aspect, without any repeating pattern. The rotational tessellation is obtained by tessellating several paired units A and B in different rotational orientations. In addition, the deep joints of the units A and B are located on their respective top faces so as to "break" the linear effect when the units are rotated. As shown in FIG. 10A, the combination of a rotational installation of the units, with the appropriate positioning of the deep joints, results in a more random and natural installation than the one presented in FIG. 10B. It is also more difficult to distinguish a linear pattern.

Of course, it is also possible to create a pavement 92' without rotating the units, and by assembling units A and B from the same or from different groups, as in FIG. 10B.

Figure 11:
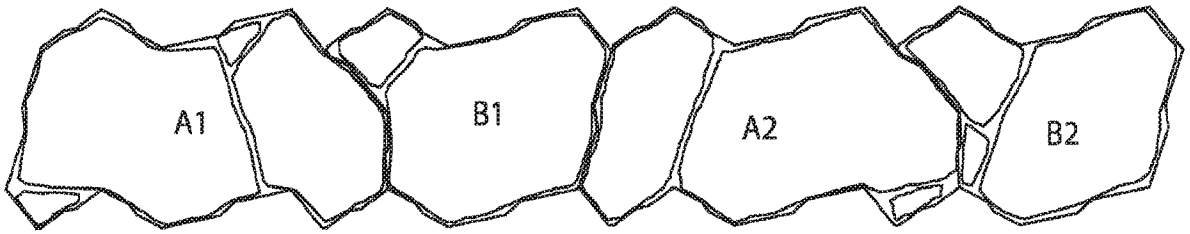
FIGS. 11 to 14 are top views of pavements made of first and second units assembled in different linear assemblies, according to different embodiments of the invention.

Referring to FIGS. 11 to 14, other possible pavements formed by a linear tessellation of several pairs of first and second units A, B are shown. In these examples, the first and second units A, B of a pair are placed side by side. FIG. 11 is an example of a horizontally aligned tessellation.

Figure 12:
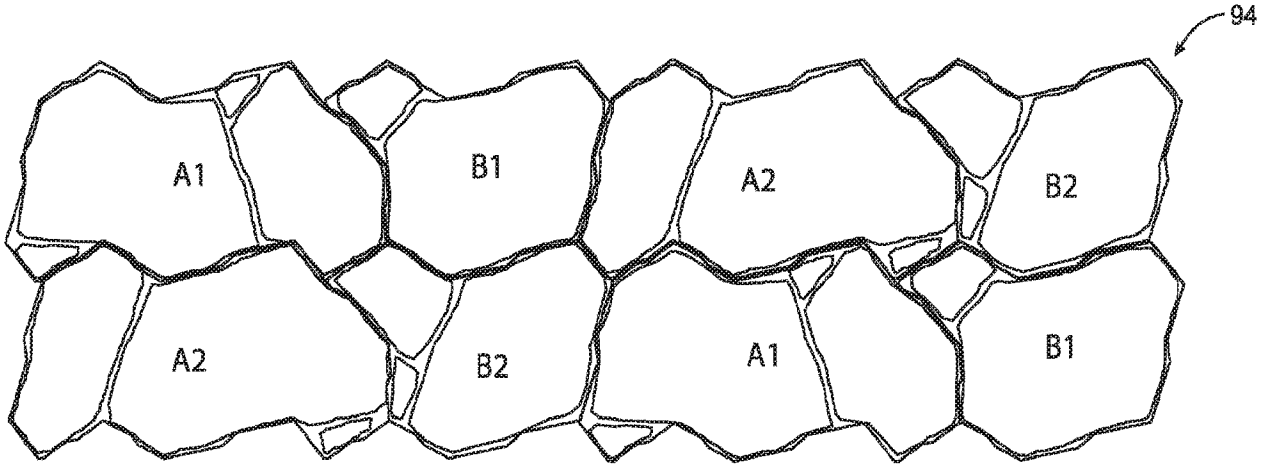
Figure 13:
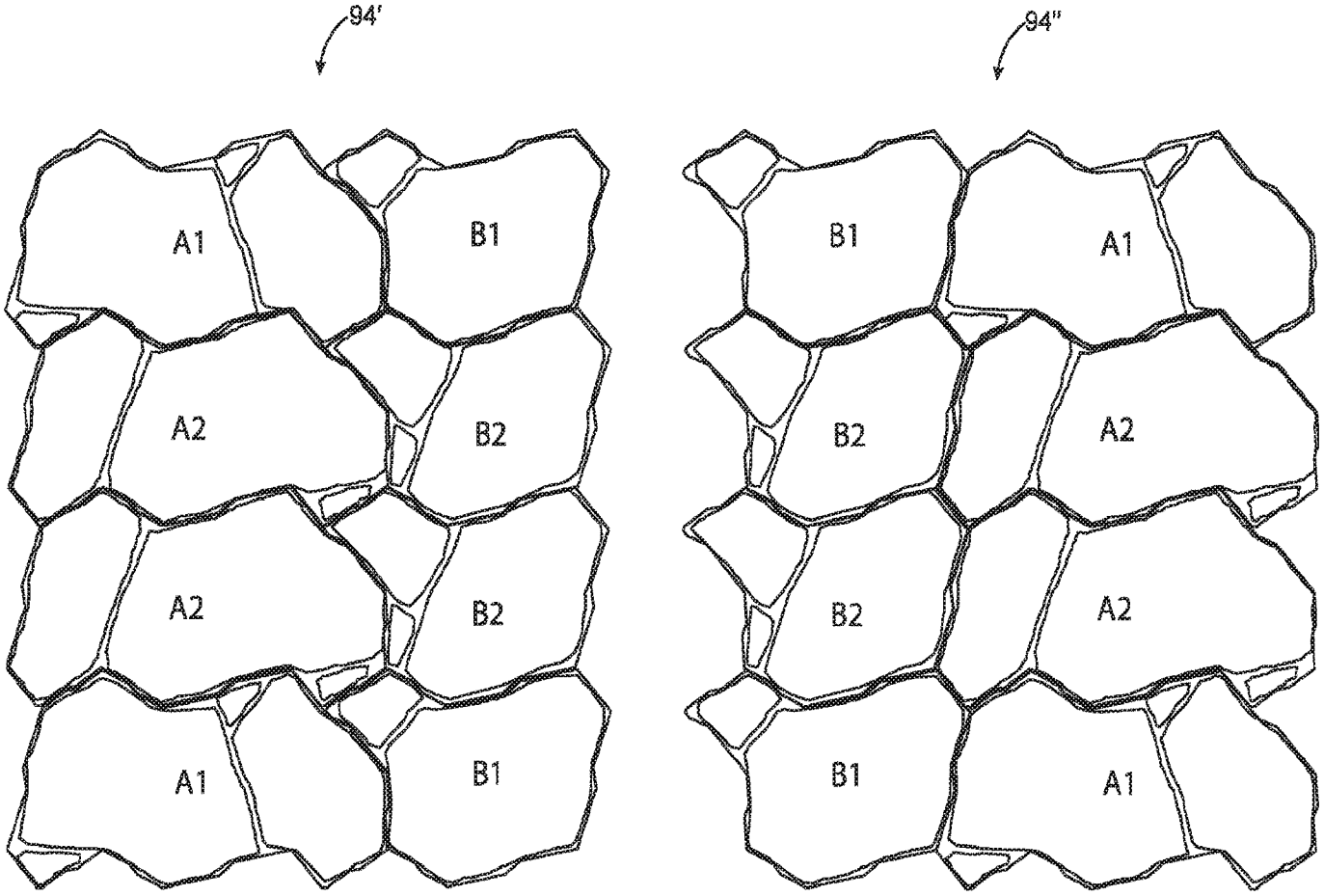

As shown in FIGS. 12 and 13, different pavements 94, 94' and 94" are made using a stack bond configuration. The pavements include at least two rows, where the first units A1 or A2 of the first row face the respective first units A2 or A1 of the second row. Similarly, units B1 or B2 are facing units B2 or B1. FIG. 13 is an example a vertically aligned tessellation.

Figure 14:
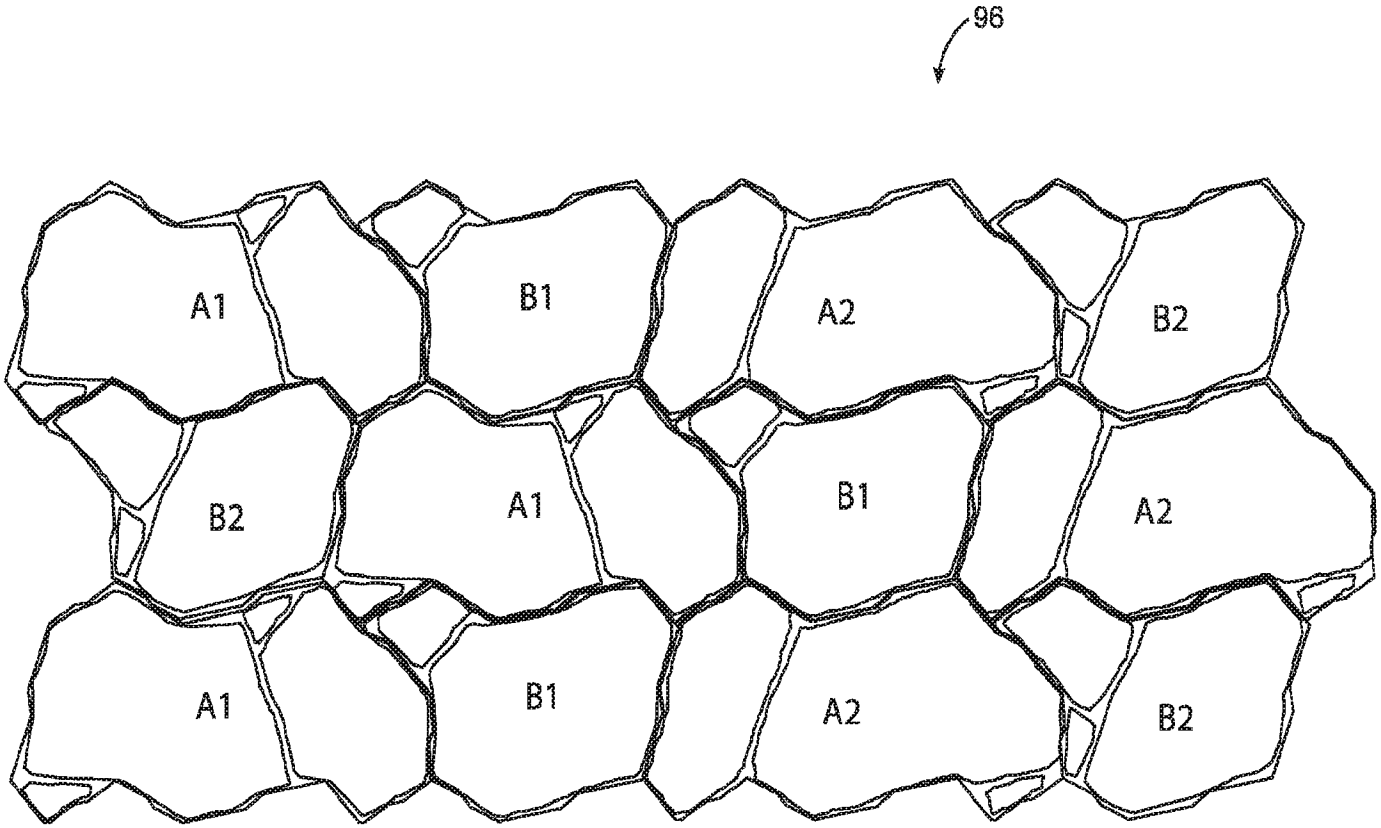

In FIG. 14, the pavement 96 is made using a running bond configuration. A running bond pavement includes at least two rows (in this particular case, three rows are used) where the first units A1 or A2 of the first row face the respective second units B1 or B2 of the second row.

As can be appreciated, the paving units of the present system allow creating, when combined, large paving modules or assemblies, having a random and natural look. Such large paving assemblies yet remain easy to install, since they are subdivided into smaller sub-units A and B, and since the modules have a substantially similar outline. In addition, a single worker is generally able to lift and install the paving units. The result of combining the first and second paving units is larger looking stones having a random look which enables to loose the linear and hexagonal shape present in existing products. In addition, the specific perimeter or outline of each paving unit advantageously facilitates their clamping during the manufacturing process and allows maximization of the space occupied by the units on the pallets.

The scope of the claims should not be limited by the preferred embodiments set forth in the examples, but should be given the broadest interpretation consistent with the description as a whole.

The invention claimed is:

1. A dual-unit paving system for covering a surface formed by a rotational tessellation of a plurality of pairs of first and second units; the dual-unit pavement system comprising:

(a) at least a first row of first and second units;

(b) a least a second row of first and second units;

(c) each of the first units having a lower face for facing the ground, an exposed upper face, and sidewalls extending from the lower face, the sidewalls of the first unit including a top side, a bottom side, a left side and a right side;

(d) each of the second units having a lower face for facing the ground, an exposed upper face, and sidewalls extending from the lower face, the sidewalls of the second unit including a top side, a bottom side, a left side and a right side, the second unit having a shape different from a shape of the first unit;

(e) the bottom side of the first unit having a non-linear, irregular outline matingly engageable with an outline of the top side of the second unit for forming a hexagonal assembly having six non-linear sides, the hexagonal assembly allowing to form rotational tessellations; and (f) the first and second units being shaped to form either a stack bond configuration or a running bond configuration;

(i) the stack bond configuration including the first units of the first row engaging against the respective first units of the second row; and (ii) the running bond configuration including the first units of the first row engaging against the second respective second units of the second row.

2. The dual-unit paving system of claim 1 wherein:

(a) the left side and the right side of each of the second units has non-linear, irregular outlines matingly engageable to at least respective portions of outlines of the right side and left side of each of the first units, allowing to form horizontally aligned tessellations;

(b) the first and second units in the first row are arranged side by side formed by horizontal tessellations; and (c) the first and second units in the second row are arranged side by side formed by horizontal tessellations.

3. The dual-unit paving system of claim 1 wherein the irregular outlines of the top side of each of the second units and the bottom sides of each of the first units comprises two summits and a valley between the two summits.

4. The dual-unit paving system of claim 3 wherein each of the two summits has a first segment and a second segment extending therefrom, the first segments being rotational images of the respective second segments.

5. The dual-unit paving system of claim 1 wherein the irregular outlines of the top side of each of the second units and the bottom sides of each of the first units comprises two outer portions and one inner portion, the inner portion having an outline similar to the bottom side of the second unit.

6. The dual-unit paving system of claim 1 wherein:

(a) the exposed upper face of at least some of the first units have two or more different patterns; and (b) the exposed upper face of at least some of the second units have two or more different patterns different from the patterns of the first units.

7. The dual-unit paving system of claim 6 wherein the patterns are flagstone patterns.

8. The dual-unit paving system of claim 6 wherein the patterns are delimited by deep joints or color.

9. The dual-unit paving system of claim 1 wherein adjacent sides of each of the hexagonal assemblies are spaced apart by an angle of approximately 120°.

10. The dual-unit paving system of claim 1 wherein the respective outlines of the top side of the second unit and of the bottom side of the first unit is a separation outline; and each of the hexagonal assemblies has first, second, third, fourth, fifth and sixth consecutive vertices, the separation outline of each extending from near the first vertex to near the fourth vertex.

* * * * *